United States Patent [19]

Allenbaugh, Jr.

[11] Patent Number: 4,465,235

[45] Date of Patent: Aug. 14, 1984

[54] FIRE-FIGHTING NOZZLE WITH SELECTIVE FLUSH CONTROL MECHANISM

[75] Inventor: George G. Allenbaugh, Jr., Wadsworth, Ohio

[73] Assignee: Premier Industrial Corporation, Cleveland, Ohio

[21] Appl. No.: 409,013

[22] Filed: Aug. 17, 1982

[51] Int. Cl.[3] ..... B05B 1/32; B05B 15/02

[52] U.S. Cl. ..... 239/107; 239/456

[58] Field of Search ..... 239/107, 452, 453, 456, 239/457

[56] References Cited

U.S. PATENT DOCUMENTS

| | | | |
|---|---|---|---|
| 3,150,829 | 9/1964 | Specht et al. | 239/107 |
| 3,893,624 | 7/1975 | Thompson | 239/453 |
| 4,289,277 | 9/1981 | Allenbaugh | 239/459 |

*Primary Examiner*—John J. Love
*Assistant Examiner*—James R. Moon, Jr.
*Attorney, Agent, or Firm*—Isler and Ornstein

[57] ABSTRACT

A constant pressure nozzle having a pressure-responsive baffle head movable toward and away from a throat element so as to define a discharge orifice. The throat being movably mounted for retraction by external control means to a debris-flushing position, but means being provided to maintain the throat in a fixed position during normal operation of the nozzle.

2 Claims, 3 Drawing Figures

FIRE-FIGHTING NOZZLE WITH SELECTIVE FLUSH CONTROL MECHANISM

BACKGROUND OF THE INVENTION

The invention relates to debris-flushing mechanism in a liquid flow nozzle and, more particularly, to a flushing mechanism for use with nozzles of the constant pressure type, such as utilized in fire fighting.

Fire-fighting nozzles have evolved from simple fixed orifice discharge devices, to adjustable gallonage flow devices, to constant pressure discharge devices, such as exemplified in recent U.S. patents to Allenbaugh, U.S. Pat. No. 4,172,559 and McMillan, U.S. Pat. No. 3,863,844. These improvements in nozzle flow structure and control have been accompanied by advances in discharge pattern control from straight stream to spray and fog, as well as by improved means for flushing entrapped debris from the nozzle outlet, as exemplified in Allenbaugh, U.S. Pat. Nos. 3,012,733 and 3,387,791.

Constant pressure nozzles differ in structure from gallonage or volume controlled nozzles in utilizing a pressure-responsive baffle head which is free to advance or retract in response to fluid supply pressures to the nozzle, thereby varying the discharge outlet or orifice and the discharge volume of fluid to maintain a constant discharge pressure and uniform reach of stream uner changing supply pressure conditions.

Although debris-flushing mechanisms have been available to significantly enlarge the discharge orifice on the controlled gallonage type of nozzle, these flushing mechanisms have not been directly adaptable to constant pressure nozzle structures. Therefore, as evidenced in U.S. Pat. No. 4,172,559, no built-in automatic flushing mechanism has been provided. Instead, for flushing debris from the nozzle, the water flow is shut off and the baffle head is removed or released from its securement to permit flushing when the water is turned on. The water is turned off again to restore the baffle head to its original position and then the nozzle can again be utilized.

It has been found that when existing forms of flushing mechanism are modified to adapt them to constant pressure nozzle structure, hydraulic pressure imbalances are created which interfere with the desitred function of constant pressure discharge in such nozzles.

The problem of flushing debris from a constant pressure nozzle, without the necessity of shutting off the water supply, and without creating the aforementioned hydraulic pressure interference with normal constant pressure function of the nozzle, is the problem to which the present invention is addressed.

SUMMARY OF THE INVENTION

It is the primary object of the invention to provide a debris-flushing mechanism for a constant pressure nozzle structure.

Another object of the invention is to provide such an improved flushing mechanism which will be operative without the necessity of shutting off water flow through the nozzle, neither when the flushing position is initiated nor when the flushing action is terminated.

A further object of the invention is to provide an improved flushing mechanism having a hydraulic pressure equalizing chamber for overcoming hydraulic pressure interference with the normal operating equilibrium of a constant pressure nozzle structure.

To accomplish the foregoing, a movable nozzle throat structure is provided which can selectively be shifted by external control means to significantly enlarge the nozzle discharge outlet to permit discharge of entrapped debris. To avoid the creation of pressure imbalances which could cause premature or undesired shifting of the movable throat, the flush mechanism is constructed to permit equalizing fluid pressure flow around the throat structure.

Other objects and advantages of the invention will become apparent during the course of the following description and with reference to the following drawings, in which like numerals are used to designate like parts throughout the same.

DESCRIPTION OF THE PREFERRED EMBODIMENT

Figure 1:
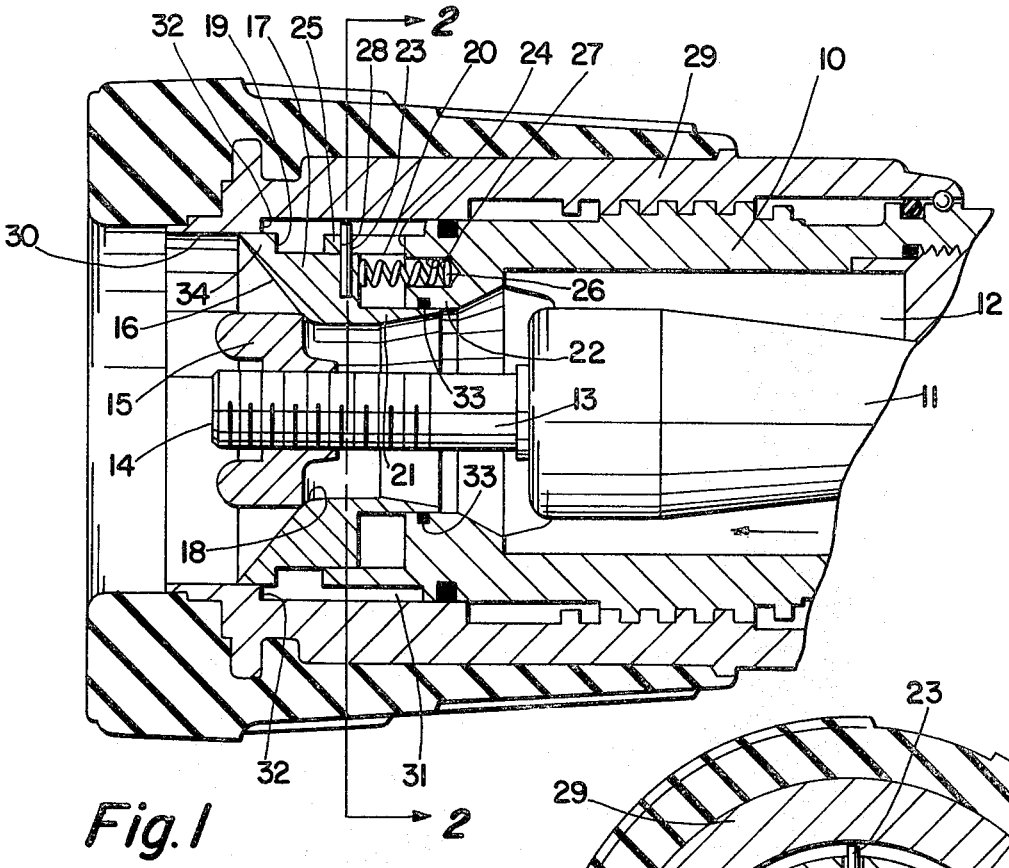
FIG. 1 is a fragmentary longitudinal cross-sectional view of the discharge end of a constant pressure nozzle embodying the improved flush control mechanism.
Figure 2:
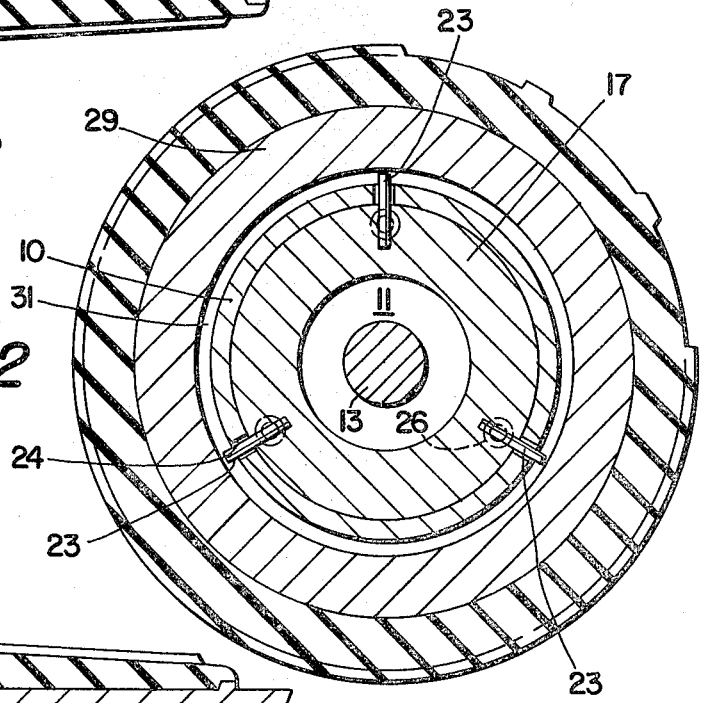
FIG. 2 is a transverse cross-section taken as indicated on line 2—2 of FIG. 1.

Referring to FIGS. 1 and 2 of the drawing, there is shown the forward or outlet end of a constant pressure flow nozzle having a hollow, cylindrical nozzle body 10 which defines a liquid flow conduit for water supplied under pressure to the nozzle in the direction of flow indicated by the arrow.

Mounted centrally of the body 10 is a spindle 11 which is fixedly retained in the body by integral circumferentially-spaced vanes or webs 12 which extend radially from the spindle to the interior wall of the body 10. The spindle slidably receives and guides the stem 13 of a baffle assembly 14. A baffle head 15 is threadedly secured to the stem in overlying relationship to the conical inclined surface 16 of a throat element 17.

The baffle head 15 is exposed to the fluid supply pressure in the nozzle and will advance forwardly in response to such pressure to move further away from the surface 16 and provide an annular orifice 18 as a discharge outlet for the nozzle. As more fully detailed in U.S. Pat. Nos. 4,172,559 and 3,863,844, to which reference is hereby made, the baffle head assembly is resiliently biased or otherwise biased to resist such pressure-responsive displacement and "hunt" for an equilibrium position which will provide constant pressure fluid discharge at the thus defined orifice under varying pressure supply conditions during use. It will be noted that the movable element in the discharge equilibrium is the baffle head 15, not the throat element, as for uniformity of performance, the throat element must remain stationary as the baffle head hunts its equilibrium position.

The throat 17 is cylindrical and is formed with a circumferential recess 19 which is further recessed, as at 20, to define a rearwardly-extending collar 21, of reduced diameter, which is telescopically or slidably received and retained on an annular ring portion 22 of the body 10.

A plurality of circumferentially-spaced, radially-extending abutment elements or guide pins 23 are mounted in the throat element 17 so that each projects through an elongated slot 24 provided on a longitudinal extension 25 of the body 10. A coil spring 26 is seated in a bore 27 in the body 10 adjacent each of the pins 23, and the opposite end of each spring 26 seats on a wall of recess 20 to urge the throat element 17 to its forwardmost position, as defined and limited by abutment of pins 23 with the forward end 28 of each slot 24. It will be understood that the circumferential spacing of the springs 26 need not conform to the spacing of the pins 23; furthermore, the quantity of springs 26 need not be equal to the quantity of pins 23 used, but can be greater or lesser. However, it is preferable that a spring 26 be utilized at least adjacent each pin 23 to insure stability of movement of the throat 17 during the flushing operation.

Threadedly secured to the nozzle body 10, externally thereof, is a cylindrical, rotatably mounted control sleeve 29 which serves both as a stream pattern adjusting means and as a flush control means.

The sleeve 29 has an inner cylindrical flow-deflecting surface 30 which projects forwardly beyond the surface 16 of the throat 17 into the path of liquid discharge.

In the position shown in FIG. 1, the angled surface 16 directs the discharge flow against the surface 30 which then deflects it into a straight-stream discharge pattern. By rotation of sleeve 29, the surface 30 can be retracted to varying selected positions which will create varying flow deflection patterns ranging from the afore-mentioned straight stream to spray or fog, as is well known in the art.

Figure 3:
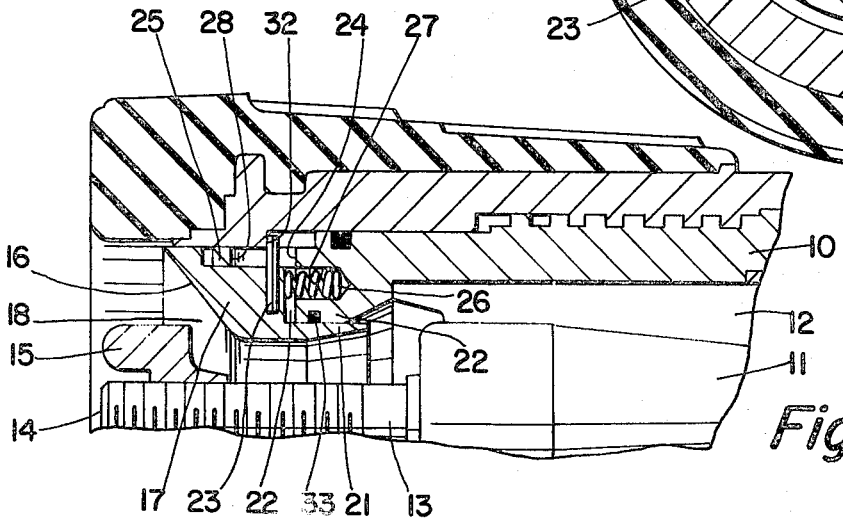
FIG. 3 is a fragmentary view similar to FIG. 1, but showing the parts retracted to debris-flushing position.

The sleeve 29 is provided with an elongated annular recess 31 forming a forward shoulder 32 on the sleeve. The pins 23 project through slots 24 into the recess 31. During normal pattern adjusting movement of the sleeve 29, the range of such movement does not bring the shoulder 32 into engagement with the pins 23. However, when entrapped debris is to be flushed from the discharge orifice of the nozzle, the sleeve 29 is rotated beyond its normal pattern-adjusting positions, to retract the sleeve rearwardly and bring shoulder 32 into engagement with pins 23 to displace throat element 17 rearwardly in opposition to the action of the springs 26, as shown in FIG. 3. Thereby, the orifice is significantly enlarged independently of the position of the baffle head 15, and the entrapped debris is readily discharged by the continued flow of water. The abutment of throat 17 with the nozzle body 10 defines the rearward limit of movement of the throat to the flushing position.

When the debris-flushing operation is completed, the control sleeve 29 is counter-rotated to restore it to a desired stream-pattern position for normal operation of the nozzle. Both the initiation of the flush position and the restoration to normal operation of the nozzle are accomplished without the necessity for shutting off the supply of water to the nozzle.

It will be noted that although an O-ring seal 33 is interposed between throat collar 21 and body 10, no attempt has been made to seal the throat element 17 at its juncture with sleeve 29 to prevent the flow of water into the recess 19 or into the chamber formed by the recess 20 at the rearward face of the throat element. Water is free to flow into these areas by passing between the forward outer end 34 of throat 17 and control sleeve 29. It has been found, contrary to prior practice and procedure, that it is necessary that the movable throat element not be sealed against outlet water pressure, but that the discharge pressure and flow be deliberately permitted around the rear of the throat in order to overcome a pressure equilibrium imbalance that would seriously interfere with uniformity of operation and satisfactory performance of a constant pressure nozzle. A brief explanation of this phenomenon follows below.

When a movable throat 17 is utilized in a constant pressure nozzle having a movable baffle head 15, it is mandatory that the throat 17 always be in a constant fixed position during normal operation of the nozzle (as distinguished from flush operation). Otherwise there would be no uniformity of pressure-responsive orifice opening in response to the baffle head movement, and a consequent negation of the desired constant pressure discharge characteristic of such nozzles. In the herein disclosed nozzle structure, the flow-exposed rear portion of the throat 17, represented by the collar 21, has a greater pressure-responsive area than the forward pressure-responsive area of the throat, as defined by that forward portion of the throat which the baffle head 15 overlies. Furthermore, the hydraulic discharge pressure on the forward portion is less than the hydraulic inlet pressure on the rearward portion of the throat. Therefore, a differential force is created between the rearward and forward portions of the throat, and such force urges the throat to its forwardmost position. The spring 26 also assists in maintaining the throat in such forwardmost position with pins 23 in abutment with the end 28 of slot 24, herein primarily when the nozzle is shut off and there is no water flow.

When the baffle head 15 moves to create the discharge orifice 18, the discharge water creates a secondary pressure on the angled surface 16 of the throat, as the discharge water is deflected by the sleeve surface 30. This secondary pressure over the large forward area of the throat, represented by surface 16, now would create a new differential force on the throat, undesirably urging the throat rearwardly in opposition to spring 26. However, this secondary pressure is directly transferred to the rear of the throat 17 by water flow into the recess 19 and chamber 20. Thereby, the static pressure in these cavities always counter-balances the secondary pressure on the surface 16, so that the first-mentioned pressure differential force is retained to urge and maintain the throat in a constant forward position. It is to be noted that this secondary pressure is variable, as it depends upon several factors including the position of the surface 30 relative to the surface 16 and the magnitude of the orifice opening. By permitting the water pressure to be continually transferred to the rear of the throat, the secondary pressure is always counter-balanced regardless of its variations. The utilization of the spaced pins 23 in lieu of a solid and sealed guide collar on the throat greatly contributes to the effectiveness of the pressure transfer to the rear of the throat by providing a large passageway for such transfer.

By utilizing a movable throat in the nozzle for debris-flushing purposes, a readily accessible external control for flushing expeditiously and conveniently can be utilized. By providing for discharge pressure transfer to the rear of the throat, the use of a movable throat does not create problems of throat shift during normal operation of the nozzle, and thereby consistency of the constant pressure discharge function is retained.

It is to be understood that the form of my invention, herewith shown and described, is to be taken as a preferred example of the same and that various changes in the shape, size and arrangement of the parts may be resorted to without departing from the spirit of the invention or the scope of the subjoined claims.

Having thus described my invention, I claim:

1. In a fire-fighting nozzle having a water-flow passageway extending therethrough to a controlled discharge outlet, the combination of:

a hollow nozzle body defining said passageway, a discharge throat slidably mounted coaxially on the forward end of said nozzle body for longitudinal movement relatively thereto and presenting a forward flow-directing surface, a baffle assembly slidably carried coaxially by said nozzle body for longitudinal movement relatively thereto, said baffle assembly presenting a baffle head in forward overlying relationship to said discharge throat to define a variable flow discharge outlet therebetween, means yieldably retaining said discharge throat in a forwardmost pre-determined position during flow-controlling movement of said baffle head, a forward surface area provided on said throat and exposed to hydraulic discharge pressure of fluid from said outlet, a rearward surface area provided on said throat and isolated from the hydraulic inlet pressure of fluid in said nozzle, a transfer passageway between said forward and rearward surface areas for balancing the hydraulic pressures on said surface area to prevent pressure-responsive shifting of said throat from said forwardmost position, and a coaxial member, external of said nozzle body, for selectively displacing said discharge throat rearwardly to a debris-flushing position relatively to said baffle head, in opposition to said retaining means.

2. A combination as defined in claim 1, wherein said retaining means comprises a resilient element biasing said throat to said forwardmost position.

* * * * *